US010662970B2

(12) United States Patent
Nakamura

(10) Patent No.: US 10,662,970 B2
(45) Date of Patent: May 26, 2020

(54) VORTEX PUMP

(71) Applicant: AISAN KOGYO KABUSHIKI KAISHA, Obu-shi, Aichi (JP)

(72) Inventor: Eiji Nakamura, Handa (JP)

(73) Assignee: AISAN KOGYO KABUSHIKI KAISHA, Obu-shi, Aichi (JP)

( * ) Notice: Subject to any disclaimer, the term of this patent is extended or adjusted under 35 U.S.C. 154(b) by 119 days.

(21) Appl. No.: 15/778,498

(22) PCT Filed: Nov. 2, 2016

(86) PCT No.: PCT/JP2016/082586
§ 371 (c)(1),
(2) Date: May 23, 2018

(87) PCT Pub. No.: WO2017/090398
PCT Pub. Date: Jun. 1, 2017

(65) Prior Publication Data

US 2019/0032672 A1 Jan. 31, 2019

(30) Foreign Application Priority Data

Nov. 24, 2015 (JP) ..... 2015-229106

(51) Int. Cl.
*F04D 29/30* (2006.01)
*F04D 23/00* (2006.01)
(Continued)

(52) U.S. Cl.
CPC ..... *F04D 29/30* (2013.01); *F04D 23/008* (2013.01); *F04D 29/188* (2013.01); *F04D 29/242* (2013.01)

(58) Field of Classification Search
CPC ..... F04D 29/188; F04D 29/242; F04D 29/30; F04D 5/002; F02M 37/08; F02M 37/048
See application file for complete search history.

(56) References Cited

U.S. PATENT DOCUMENTS 3,095,820 A * 7/1963 Sanborn ..... F04D 29/161 415/55.4
5,310,308 A 5/1994 Yu et al.
(Continued)

FOREIGN PATENT DOCUMENTS

CN 201874711 U 6/2011
JP H2-215997 A 8/1990
(Continued)

OTHER PUBLICATIONS

English Translation of International Preliminary Examination Report for PCT/JP2016/082586 dated Feb. 2, 2018 (8 pages).
(Continued)

*Primary Examiner* — Kenneth J Hansen
*Assistant Examiner* — Jackson N Gillenwaters
(74) *Attorney, Agent, or Firm* — Shumaker, Loop & Kendrick, LLP

(57) ABSTRACT

An impeller may include a plurality of blades disposed along a rotation direction in an outer circumferential portion of at least one end surface of two end surfaces of the impeller; a plurality of blade grooves; and an outer circumferential wall disposed at an outer circumferential edge and closing the plurality of grooves. The housing may include an opposing groove opposing a blade groove region and extending along the rotation direction of the impeller. In a plan view of the one end surface of the two end surfaces of the impeller, each of the plurality of the blades may be curved, and a central portion of each of the blades may be positioned frontward in the rotation direction of the impeller than both ends of the blade.

3 Claims, 8 Drawing Sheets

(51) Int. Cl.
*F04D 29/18* (2006.01)
*F04D 29/24* (2006.01)

(56) References Cited

U.S. PATENT DOCUMENTS

| | | | | |
|---|---|---|---|---|
| 5,395,210 | A | 3/1995 | Yamazaki et al. | |
| 5,472,321 | A * | 12/1995 | Radermacher | F02M 37/048 417/365 |
| 5,536,139 | A | 7/1996 | Yamazaki et al. | |
| 5,697,152 | A | 12/1997 | Yamazaki et al. | |
| 6,224,323 | B1 * | 5/2001 | Murase | F02M 37/08 415/55.1 |
| 6,468,051 | B2 | 10/2002 | Lampe et al. | |
| 6,695,895 | B2 * | 2/2004 | Hyodo | F02M 25/089 123/519 |
| 6,767,179 | B2 * | 7/2004 | Kusagaya | F02M 37/048 415/55.1 |
| 6,846,155 | B2 * | 1/2005 | Takami | F04D 29/188 415/55.1 |
| 8,070,417 | B2 * | 12/2011 | Ikeya | F04D 29/188 415/55.1 |
| 8,297,913 | B2 * | 10/2012 | Hanai | F04D 5/002 415/106 |
| 9,249,806 | B2 | 2/2016 | Talaski | |
| 2002/0162457 | A1 | 11/2002 | Hyodo | |
| 2003/0108418 | A1 * | 6/2003 | Yu | F04D 29/188 415/55.1 |
| 2003/0118438 | A1 | 6/2003 | Usui et al. | |
| 2016/0208747 | A1 * | 7/2016 | Hidaka | F02M 37/10 |

FOREIGN PATENT DOCUMENTS

| | | | |
|---|---|---|---|
| JP | H02215997 | * | 8/1990 |
| JP | H7-167081 | A | 7/1995 |
| JP | H7-180626 | A | 7/1995 |
| JP | 2000-329096 | A | 11/2000 |
| JP | 2002-081392 | A | 3/2002 |
| JP | 2003-042014 | A | 2/2003 |
| JP | 2003-193992 | A | 7/2003 |
| JP | 2007-247421 | A | 9/2007 |
| JP | 2008-031889 | A | 2/2008 |
| JP | 2012-163099 | A | 8/2012 |

OTHER PUBLICATIONS

International Search Report for PCT/JP2016/082586 dated Jan. 24, 2017 (2 pages).
Chinese Office Action for Chinese Pat. App. No. 201680057749.7 dated Mar. 14, 2019 with English Translation (13 pages).
Chinese Office Action for CN Pat. App. No. 201680057749.7 dated Oct. 23, 2019 (12 pages including English Translation).

* cited by examiner

VORTEX PUMP

TECHNICAL FIELD

The description herein relates to a vortex pump that pumps a gas. The vortex pump may also be called a Wesco pump, a cascade pump, or a regenerative pump.

BACKGROUND ART

Japanese Patent Application Publication No. 2012-163099 describes a fuel pump that supplies fuel to a vehicle engine. The fuel pump includes an impeller having a plurality of blades arranged along a circumferential direction. Blade grooves are provided between respective pairs of adjacent blades. The plurality of blades and the plurality of blade grooves are arranged on both surfaces of the impeller. Each of the plurality of blade grooves arranged on one of the surfaces of the impeller communicates with a corresponding one of the plurality of blade grooves arranged on the other surface of the impeller.

SUMMARY

Technical Problem

A vortex pump generates a vortex (which is also called a swirling flow) about a center axis along a rotation direction of an impeller by rotating the impeller. Fluid is thereby pressurized and discharged. Due to this, shapes of blades and blade grooves arranged on the impeller affect pump efficiency. In the description herein, a technique that improves pump efficiency by shapes of blades and blade grooves arranged in an impeller of a vortex pump that pumps a gas is provided.

Solution to Problem

The description herein discloses a vortex pump configured to pump a gas. The vortex pump may comprise a housing and an impeller housed in the housing and configured to rotate about a rotation axis. The impeller may comprise a plurality of blades disposed along a rotation direction in an outer circumferential portion of at least one end surface of two end surfaces of the impeller, a plurality of blade grooves, each of the plurality of blade grooves being disposed between adjacent blades, and an outer circumferential wall disposed at an outer circumferential edge and closing the plurality of grooves at an outer circumferential side of the impeller. The housing may comprise an opposing groove opposing a blade groove region and extending along the rotation direction of the impeller. Each of the plurality of the blade grooves may be opened at the one end surface of the two end surfaces of the impeller, and closed at the other end surface of the two end surfaces of the impeller. In a plan view of the one end surface of the two end surfaces of the impeller, each of the plurality of the blades may be curved, and a central portion of each of the blades may be positioned frontward in the rotation direction of the impeller than both ends of the blade.

The inventors discovered that occurrences of separated flows in a vortex (or swirling flow) generated in a space between the blade grooves and the opposing groove may be suppressed and the gas can be smoothly swirled by shapes of the blades and the blade grooves as above. According to the above configuration, pump efficiency may be improved in the vortex gas pump.

In the plan view of the one end surface of the impeller, in each of the plurality of the blades, a line connecting an end thereof on an outer circumferential side of the impeller and a center of the impeller may be positioned backward in the rotation direction of the impeller than a line connecting an end thereof on a central side of the impeller and the center of the impeller. The pump efficiency may be improved by the shapes of the blades and the blade grooves as above.

In each of the plurality of the blades, an end portion thereof on the one end surface side of the impeller may be positioned frontward in the rotation direction of the impeller than an end portion thereof on the other end surface side of the impeller. The pump efficiency may be improved by the shapes of the blades and the blade grooves as above.

Each of the plurality of the blades may be inclined such that the end portion thereof on the one end surface side of the impeller may be positioned frontward in the rotation direction of the impeller than the end portion thereof on the other end surface side of the impeller.

The vortex pump may be mounted on an automobile, suction vaporized fuel from a canister adsorbing the vaporized fuel in a fuel tank into the vortex pump and supply the suctioned vaporized fuel to an intake pipe of an engine of the automobile. The vortex pump having the shapes of the blades and the blade grooves of present embodiment may smoothly generate a vortex even with a gas with a relatively small density. Due to this, the gas may be pressurized without setting a revolution speed of the impeller high. By employing the vortex pump of the present embodiment in the aforementioned system, the vaporized fuel may suitably be supplied to the suction pipe of the engine.

DETAILED DESCRIPTION

Figure 1:
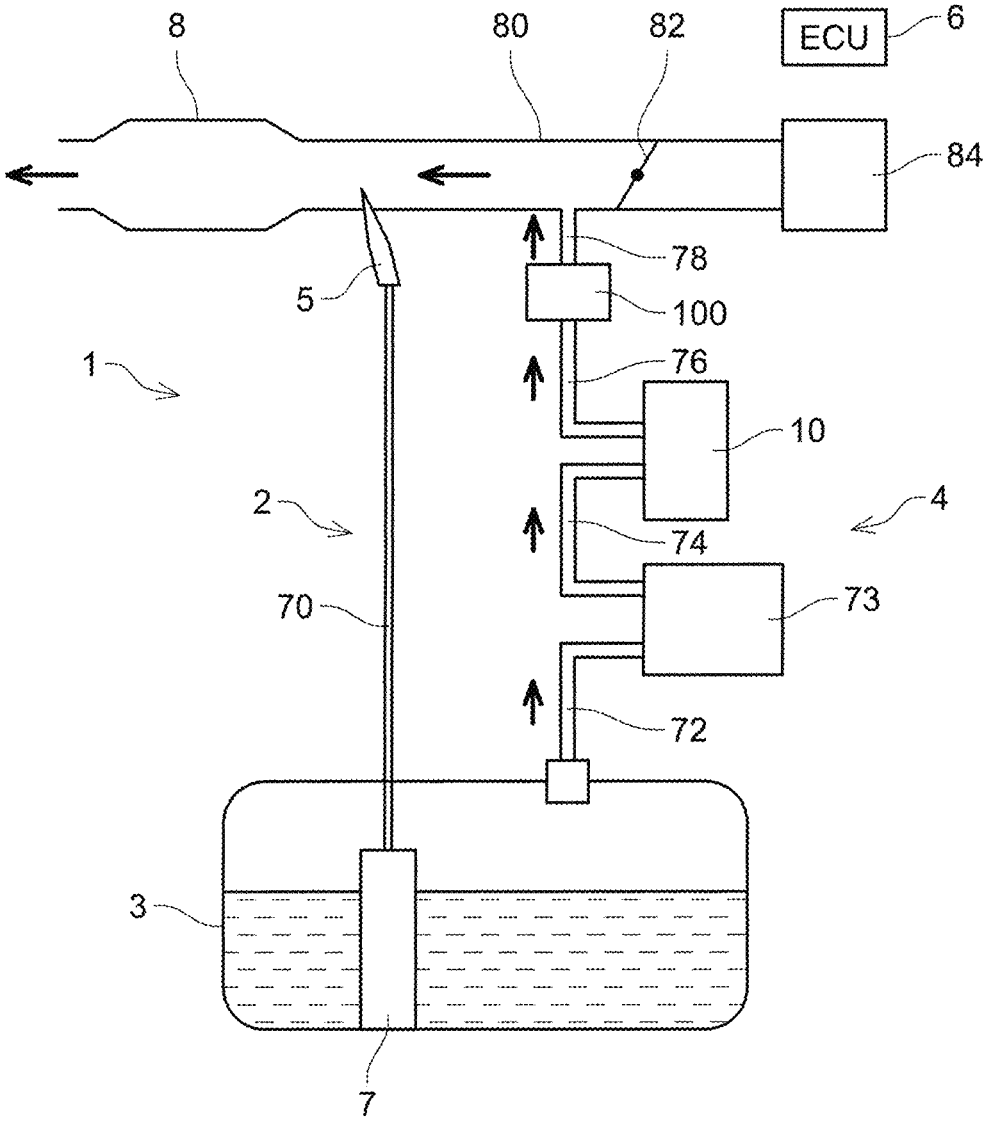
FIG. 1 shows a schematic overview of a fuel supply system for a vehicle of an embodiment.

A purge pump 10 of a first embodiment will be described with reference to the drawings. As shown in FIG. 1, the purge pump 10 is mounted in a vehicle, and is arranged in a fuel supply system 1 that supplies fuel stored in a fuel tank 3 to an engine 8. The fuel supply system 1 includes a main supply 2 and a purge supply passage 4 for supplying the fuel from the fuel tank 3 to the engine 8.

The main supply passage 2 includes a fuel pump unit 7, a supply pipe 70, and an injector 5 arranged thereon. The fuel pump unit 7 includes a fuel pump, a pressure regulator, a control circuit, and the like. In the fuel pump unit 7, the control circuit controls the fuel pump according to a signal supplied from an ECU (abbreviation of Engine Control Unit) 6 to be described later. The fuel pump pressurizes and discharges the fuel in the fuel tank 3. The fuel discharged from the fuel pump is regulated by the pressure regulator, and is supplied from the fuel pump unit 7 to the supply pipe 70.

The supply pipe 70 communicates the fuel pump unit 7 and the injector 5. The fuel supplied to the supply pipe 70 flows in the supply pipe 70 to the injector 5. The injector 5 includes a valve of which aperture is controlled by the ECU 6. When this valve is opened, the injector 5 supplies the fuel supplied from the supply pipe 70 to the engine 8.

The purge supply passage 4 is provided with a canister 73, a purge pump 10, a VSV (abbreviation of Vacuum Switching Valve) 100, and communicating pipes 72, 74, 76, 78 communicating them. The canister 73 absorbs vaporized fuel generated in the fuel tank 3. The canister 73 includes a tank port, a purge port, and an open-air port. FIG. 1 shows a flowing direction of the gas in the purge supply passage 4 and the suction pipe 80 by arrows. The tank port is connected to the communicating pipe 72 extending from an upper end of the fuel tank 3. Due to this, the canister 73 is communicated with the communicating pipe 72 extending from the upper end of the fuel tank 3. The canister 73 accommodates an activated charcoal capable of absorbing the fuel. The activated charcoal absorbs the vaporized fuel from gas that enters into the canister 73 from the fuel tank 3 through the communicating pipe 72. The gas that had flown in to the canister 73 passes through the open-air port of the canister 73 after the vaporized fuel has been absorbed, and is discharged to open air. Due to this, the vaporized fuel can be suppressed from being discharged to open air.

The purge port of the canister 73 connects to the purge pump 10 via the communicating pipe 74. Although a detailed structure will be described later, the purge pump 10 is a so-called vortex pump that pressure-feeds gas. The purge pump 10 is controlled by the ECU 6. The purge pump 10 suctions the vaporized fuel absorbed in the canister 73 and pressurizes and discharges the same. During when the purge pump 10 is driving, air is suctioned from the open-air port in the canister 73, and is flown to the purge pump 10 together with the vaporized fuel.

The vaporized fuel discharged from the purge pump 10 passes through the communicating pipe 76, the VSV 100, and the communicating pipe 78, and flows into the suction pipe 80. The VSV 100 is an electromagnetic valve controlled by the ECU 6. The ECU 60 controls the VSV 100 for adjusting a vaporized fuel amount supplied from the purge supply passage 4 to the suction pipe 80. The VSV 100 is connected to the suction pipe 80 upstream of the injector 5. The suction pipe 80 is a pipe that supplies air to the engine 8. A throttle valve 82 is arranged on the suction pipe 80 upstream of a position where the VSV 100 is connected to the suction pipe 80. The throttle valve 82 controls an aperture of the suction pipe 80 to adjust the air flowing into the engine 8. The throttle valve 82 is controlled by the ECU 6.

An air cleaner 84 is arranged on the suction pipe 80 upstream of the throttle valve 82. The air cleaner 84 includes a filter that removes foreign particles from the air flowing into the suction pipe 80. In the suction pipe 80, when the throttle valve 82 opens, the air is suctioned from the air cleaner 84 toward the engine 8. The engine 8 internally combusts the air and the fuel from the suction pipe 80 and discharges exhaust after the combustion.

In the purge supply passage 4, the vaporized fuel absorbed in the canister 73 can be supplied to the suction pipe 80 by driving the purge pump 10. In a case where the engine 8 is running, a negative pressure is generated in the suction pipe 80. Due to this, even in a state where the purge pump 10 is at a halt, the vaporized fuel absorbed in the canister 73 is suctioned into the suction pipe 80 by passing through the halted purge pump 10 due to the negative pressure in the suction pipe 80. On the other hand, in cases of terminating idling of the engine 8 upon stopping the vehicle and running by a motor while the engine 8 is halted as in a hybrid vehicle, that is, in other words in a case of controlling an operation of the engine 8 in an ecofriendly mode, a situation arises in which the negative pressure in the suction pipe 80 by the operation of the engine 8 is hardly generated. In such a situation, the purge pump 10 can supply the vaporized fuel absorbed in the canister 73 to the suction pipe 80 by taking over this role from the engine 8. In a variant, the purge pump 10 may be driven to suction and discharge the vaporized fuel even in the situation where the engine 8 is running and the negative pressure is being generated in the suction pipe 80.

Figure 2:
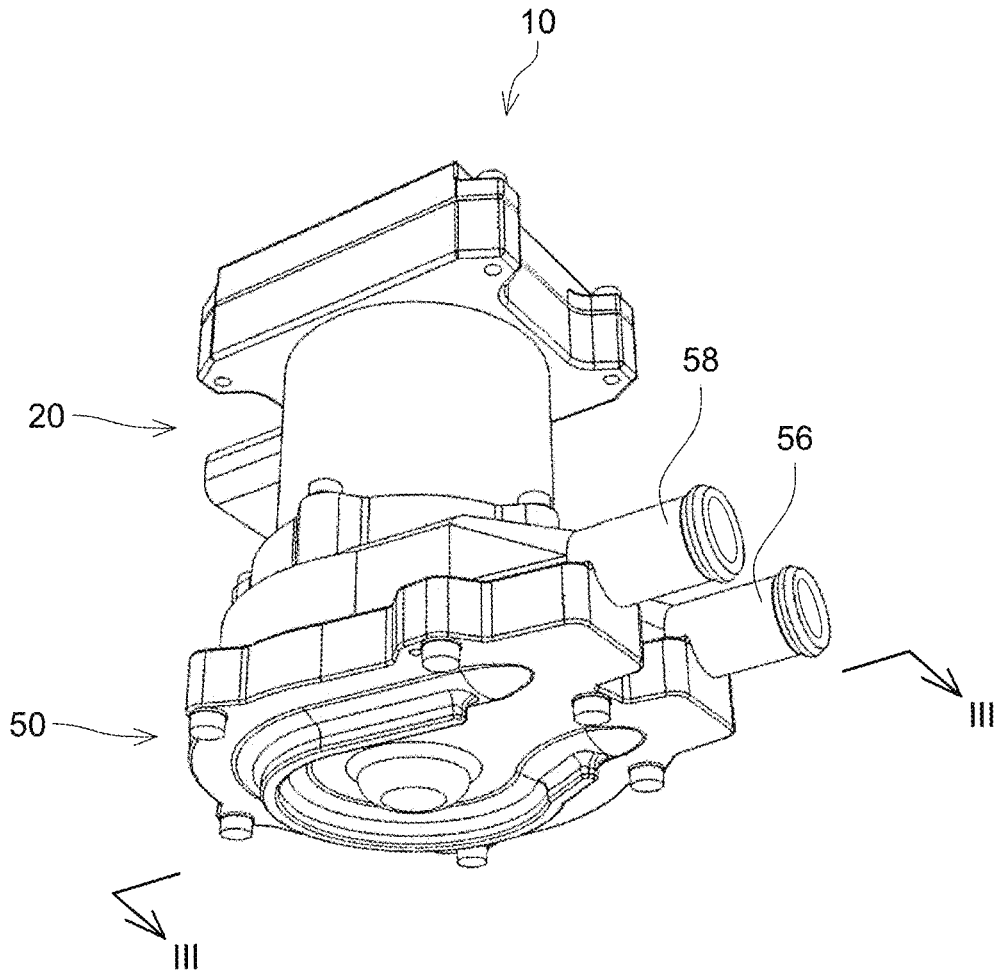
FIG. 2 shows a perspective view of a purge pump of the embodiment.
Figure 3:
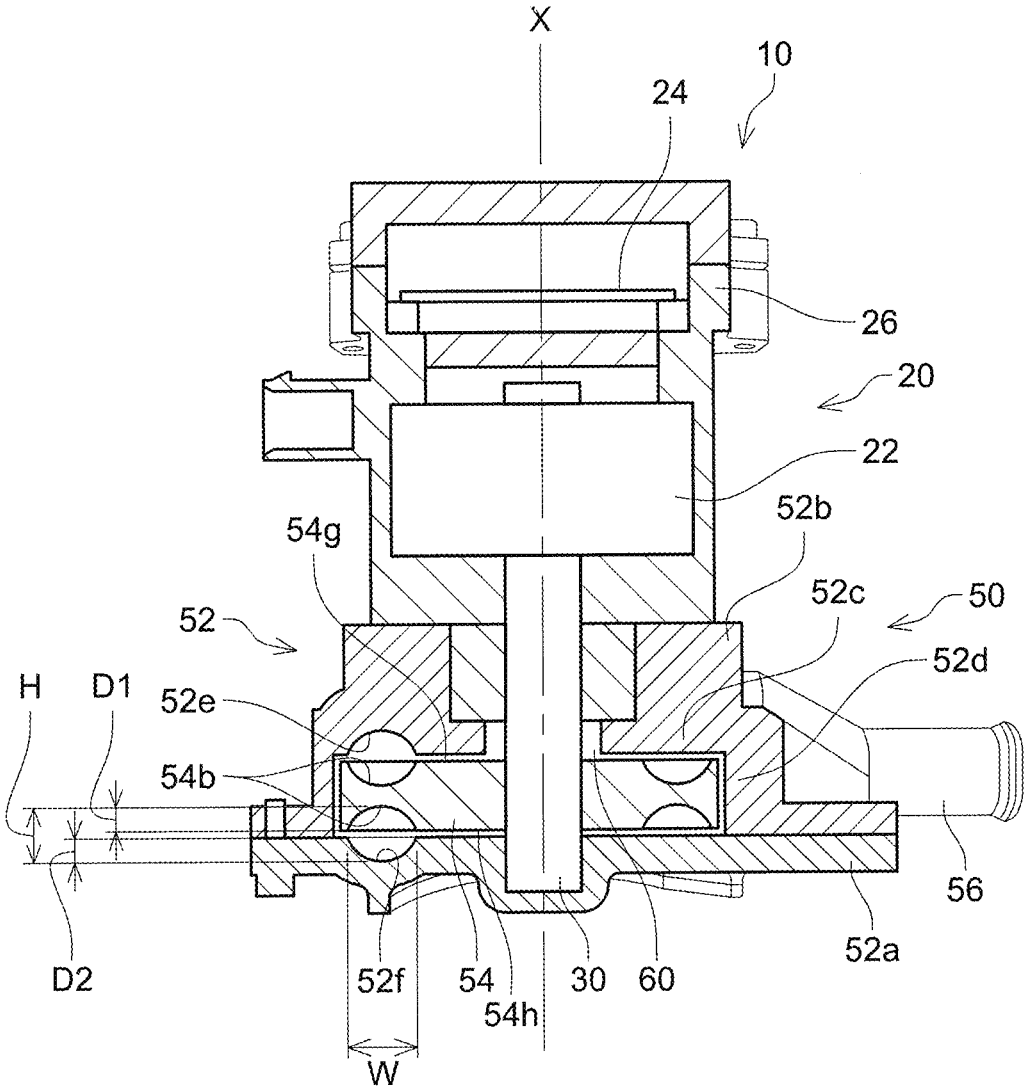
FIG. 3 shows a cross-sectional view along a III-III cross section of FIG. 2.

Next, a configuration of the purge pump 10 will be described. FIG. 2 shows a perspective view of the purge pump 10 as seen from a pump unit 50 side. FIG. 3 is a cross sectional view showing a cross section of FIG. 2. Hereinbelow, "up" and "down" will be expressed with an up and down direction of FIG. 3 as a reference, however, the up and down direction of FIG. 3 may not be a direction by which the purge pump 10 is mounted on the vehicle.

The purge pump 10 includes a motor unit 20 and a pump unit 50. The motor unit 20 includes a brushless motor. The motor unit 20 is provided with an upper housing 26, a rotor (not shown), a stator 22, and a control circuit 24. The upper housing 26 accommodates the rotor, the stator 22, and the control circuit 24. The control circuit 24 converts DC power supplied from a battery of the vehicle to three-phase AC power in U phase, V phase, and W phase, and supplies the same to the stator 22. The control circuit 24 supplies the power to the stator 22 according to a signal supplied from the ECU 6. The stator 22 has a cylindrical shape, at a center of which the rotor is arranged. The rotor is arranged rotatable relative to the stator 22. The rotor includes permanent magnets along its circumferential direction, which are magnetized alternately in different directions. The rotor rotates about a center axis X (called a "rotation axis X" hereinafter) a shaft 30 by the power being supplied to the stator 22.

The pump unit 50 is arranged below the motor unit 20. The pump unit 50 is driven by the motor unit 20. The pump unit 50 includes a lower housing 52 and an impeller 54. The lower housing 52 is fixed to a lower end of the upper housing 26. The lower housing 52 includes a bottom wall **52*a* and a cover 52*b*. The cover 52*b* includes an upper wall 52*c*, a circumferential wall 52*d*, a suction port 56, and a discharge port 58 (see FIG. 2). The upper wall 52*c* is arranged at the lower end of the upper housing 26. The circumferential wall 52*d* protrudes from the upper wall 52*c* downward, and surrounds an outer circumference of a circumferential edge of the upper wall 52*c*. The bottom wall 52*a* is arranged at a lower end of the circumferential wall 52*d*. The bottom wall 52*a* is fixed to the cover 52*b* by bolts. The bottom wall 52*a* closes the tower end of the circumferential wall 52*d*. A space 60 is defined by the bottom wall 52*a* and the cover 52*b***.

Figure 6:
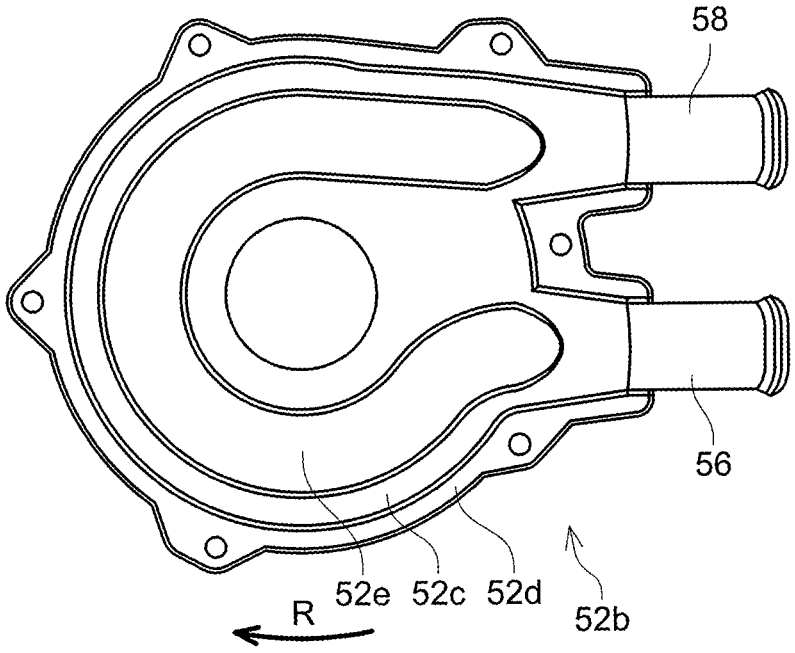
FIG. 6 shows a bottom view seeing a cover of the embodiment from below.

FIG. 6 is a diagram seeing the cover **52*b* from below. The circumferential wall 52*d* has the suction port 56 and the discharge port 58 which respectively communicates with the space 60 protruding therefrom. The suction port 56 and the discharge port 58 are arranged parallel to each other and perpencicular to the up and down direction. The suction port 56 communicates with the canister 73 via the communicating pipe 74. The suction port 56 introduces the vaporized fuel from the canister 73 into the space 60. The discharge port 58 communicates with the suction port 56 in the lower housing 52, and discharges the vaporized fuel suctioned into the space 60 to outside the purge pump 10**.

The upper wall 52*c* includes an opposing groove 52*e* extending from the suction port 56 to the discharge port 58 along the circumferential wall 52*d*. The bottom wall 52*a* similarly includes an opposing groove 52*f* (see FIG. 3) extending from the suction port 56 to the discharge port 58 along the circumferential wall 52*d*. The opposing groove 52*e* and the opposing groove 52*f* each have a constant depth at their respective intermediate positions excluding their both ends in a longitudinal direction, specifically, at respective positions opposing the impeller 54; and at their both ends in the longitudinal direction, they each become shallower toward the suction port 56 and the discharge port 58, respectively. When seen along a rotation direction R of the impeller 54, the discharge port 58 and the suction port 56 are separated by the circumferential wall 52*d*. Due to this, gas can be suppressed from flowing from the high-pressure discharge port 58 to the low-pressure suction port 56.

As shown in FIG. 3, the space 60 accommodates the impeller 54. The impeller 54 has a circular disk-like shape. A thickness of the impeller 54 is somewhat smaller than a gap between the upper wall 52*c* and the bottom wall 52*a* of the lower housing 52. The impeller 54 opposes each of the upper wall 52*c* and the bottom wall 52*a* with a small gap in between. Further, a small gap is provided between the impeller 54 and the circumferential wall 52*d*. The impeller 54 includes a fitting hole at its center for fitting the shaft 30. Due to this, the impeller 54 rotates about a rotation axis X accompanying rotation of the shaft 30. A center of the impeller 54 is located on the rotation axis X. Hereinbelow, the center of the impeller 54 will be termed a "center X".

Figure 4:
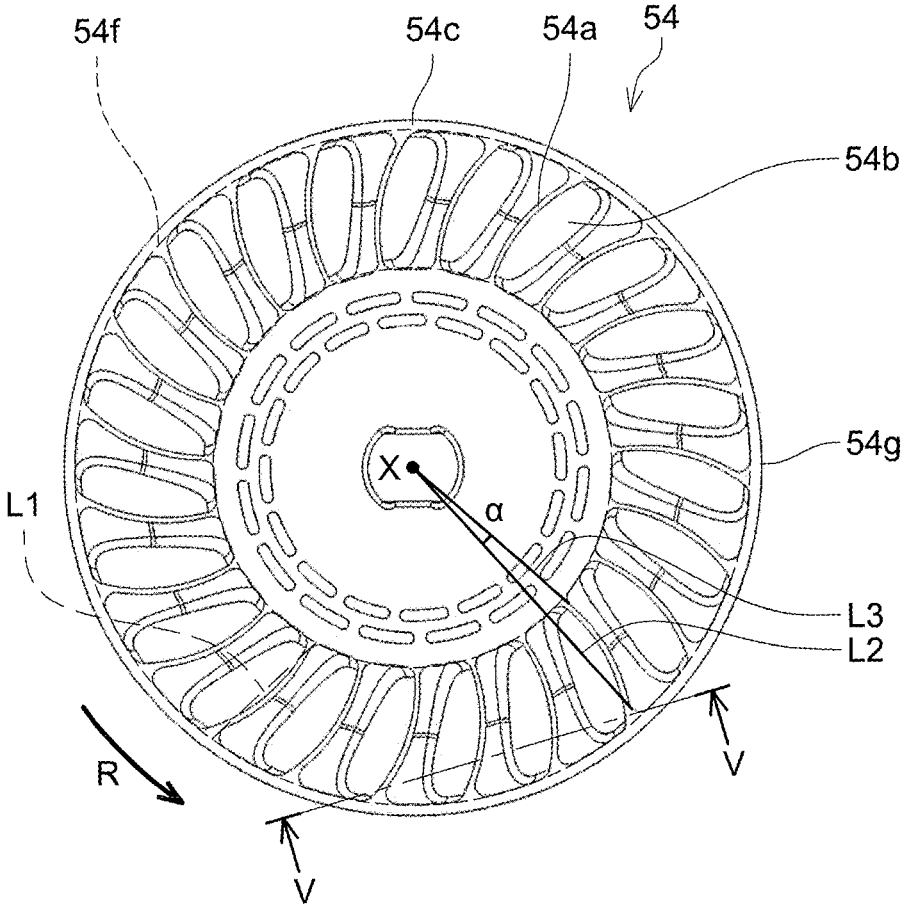
FIG. 4 shows a plan view of an impeller of the embodiment.

As shown in FIG. 4, the impeller 54 includes a blade groove region 54*f*, which includes a plurality of blades 54*a* and a plurality of blade grooves 54*b*, at an outer circumferential portion of its upper surface 54*g*. In the drawings, reference signs are given only to one blade 54*a* and one blade groove 54*b*. Similarly, the impeller 54 further includes a blade groove region 54*f*, which includes a plurality of blades 54*a* and a plurality of blade grooves 54*b*, at an outer circumferential portion of its lower surface 54*h*. The blade groove region 54*f* of the lower surface 54*h* and the blade groove region 54*f* of the upper surface 54*g* are arranged symmetrically relative to a plane that is perpendicular to a rotation axis X direction of the impeller 54, and passes through a center of the impeller 54 in an up and down direction. The upper surface 54*g* and the lower surface 54*h* can be termed end surfaces of the impeller 54 in the rotation axis X direction. The blade groove region 54*f* arranged in the upper surface 54*g* is arranged opposing the opposing groove 52*e*. Similarly, the blade groove region 54*f* arranged in the lower surface 54*h* is arranged opposing the opposing groove 52*f*. Each of the blade groove regions 54*f* surrounds the outer circumference of the impeller 54 in the circumferential direction at an inner side of the outer circumferential wall 54*c* of the impeller 54. The plurality of blades 54*a* each has a same shape. The plurality of blades 54*a* is arranged at an equal interval in the circumferential direction of the impeller 54 in each blade groove region 541. One blade groove 54*b* is arranged between two blades 54*a* that are adjacent in the circumferential direction of the impeller 54. That is, the plurality of blade grooves 54*b* is arranged at an equal interval in the circumferential direction of the impeller 54 on the inner side of the outer circumferential wall 54*c* of the impeller 54. In other words, each of the plurality of blade grooves 54*b* has its end on an outer circumferential side closed by the outer circumferential wall 54*c*.

Each of the blades 54*a* is curved such that its central portion in the radial direction of the impeller 54 protrudes in the rotation direction R. Due to this, the central portion of each blade 54*a* is located frontward in the rotation direction R of the impeller 54 than a line L1 connecting both ends of this blade 54*a*. Moreover, a line L2 connecting an end of each blade 54*a* on an outer circumferential side of the impeller 54 and the center X of the impeller 54 is located backward in the rotation direction R of the impeller 54 than a line L3 connecting an end of this blade 54*a* on a center X side of the impeller 54 and the center X of the impeller 54. Hereinbelow, an angle $\alpha$ formed by the lines L2 and L3 is termed a "sweep forward angle $\alpha$", and in a case where the line L2 is located backward than the line L3 as in the impeller 54 of this embodiment, the sweep forward angle $\alpha$ is smaller than 0 degrees.

Figure 5:
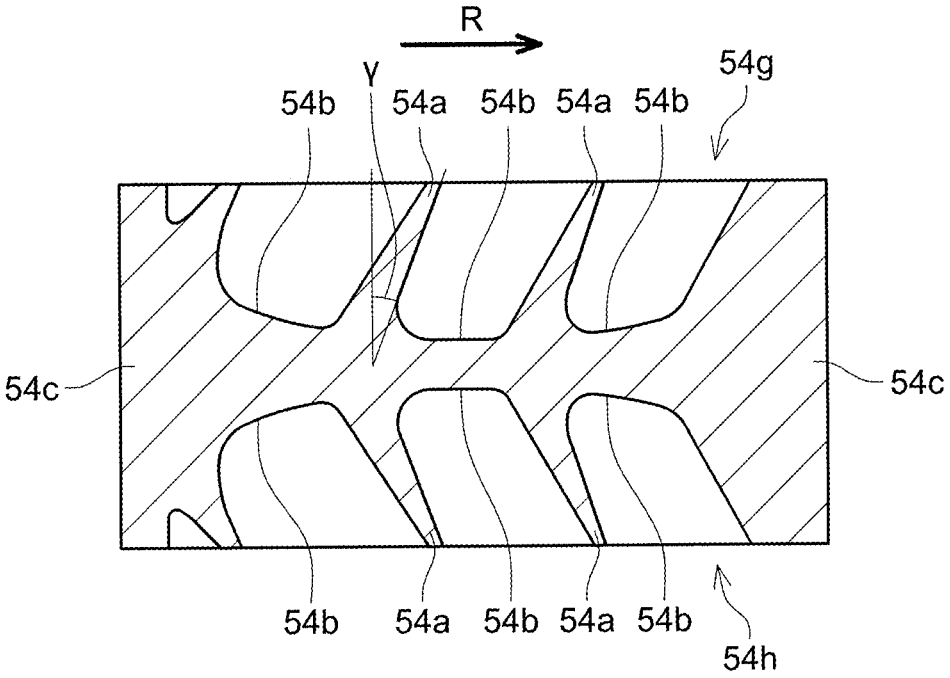
FIG. 5 shows a cross-sectional view along a V-V cross section of FIG. 4.

As shown in FIG. 5, the blades 54*a* located on the upper surface 54*g* side are inclined relative to the rotation axis X, and their ends on the upper surface 54*g* side are located frontward in the rotation direction R than their ends on the lower surface 54*h* side. An inclined angle $\gamma$ formed by a vertical line and a line connecting each end on the upper surface 54*g* side and its corresponding end on the lower surface 54*h* side is greater than 0 degrees. Similarly, the blades 54*a* located on the lower surface 54*h* side are inclined relative to the rotation axis X, and their ends on the lower surface 54*h* side are located frontward in the rotation direction R than their ends on the upper surface 54*g* side.

Next, results of simulation carried out using the purge pump 10 will be shown with reference to FIGS. 7 to 10. In the simulation, the pump unit 50 of the purge pump 10 was modelized and a flow rate of the gas discharged from the discharge port 58 when the impeller 54 rotates was calculated.

Figure 7:
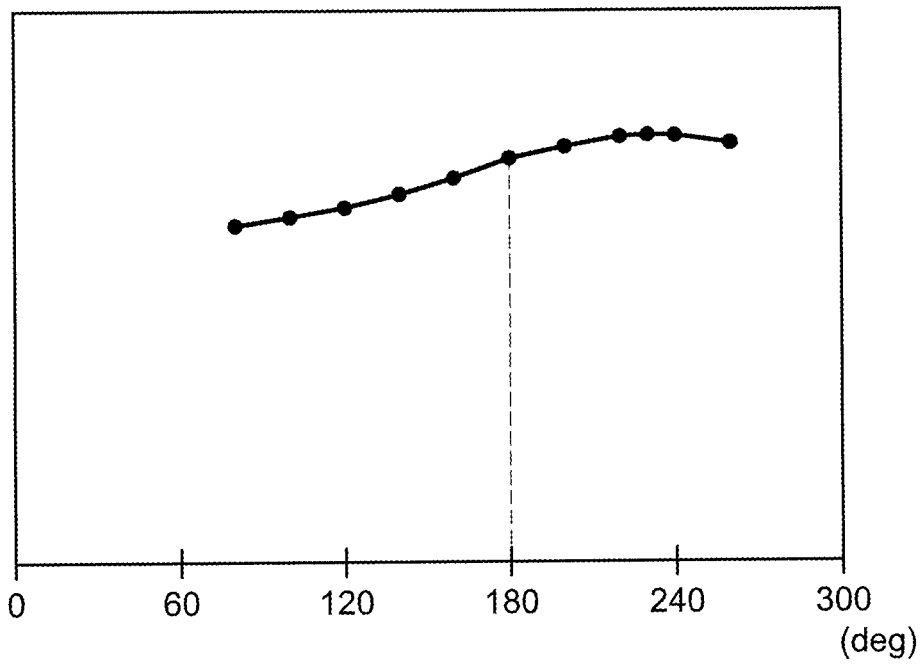
FIG. 7 shows a simulation result showing a relationship between a setting angle $\beta$ and a flow rate.
Figure 8:
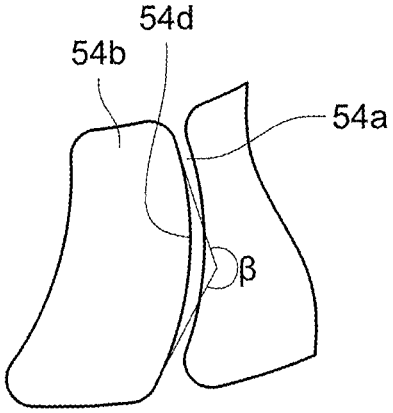
FIG. 8 shows a diagram for explaining the setting angle $\beta$.

In the simulation, a rate D2/D1 of an opposing groove depth D2 to a blade groove depth D1 shown in FIG. 3 was set to 0.6, and a rate W/H of a channel width W to a channel height H was set to 1.0. The discharge flow rates for cases of varying the sweep forward angle $\alpha$ and a setting angle $\beta$ by changing curved states of the blades 54*a* were calculated. In the simulation, the inclined angle $\gamma$ was not changed and was set as a constant angle. As shown in FIG. 8, the setting angle $\beta$ is an angle formed by tangential lines of both ends of an edge 54*d* of each blade 54*a* which is located on a back side in the rotation direction R. The setting angle $\beta$ of the impeller 54 in this embodiment is greater than 180 degrees. Further, the sweep forward angle $\alpha$ of the impeller 54 in this embodiment is less than 0 degrees. FIG. 7 is a graph showing a relationship of the setting angle $\beta$ and the discharge flow rate, where a horizontal axis indicates the setting angle $\beta$ and a vertical axis indicates the discharge flow rate (litter/min). The discharge flow rate becomes larger in a case where the setting angle $\beta$ is greater than 180 degrees, that is, when the blades 54*a* have a curved shape in which the central portion of each of the blades 54*a* is located frontward in the rotation direction R of the impeller 54 than the line L1 connecting both ends of the blade 54*a* than in a case where the setting angle $\beta$ is equal to or smaller than 180 degrees, that is, when the blades 54*a* have a curved shape in which the central portion of each of the blades 54*a* is located on its corresponding line L1 or backward in the rotation direction R of the impeller 54 than the line L1 connecting both ends of the blade 54*a*. That is, the pump efficiency can be improved by curving the blades 54*a* so that the central portions of the blades 54*a* are located frontward in the rotation direction R than the lines L1.

Figure 9:
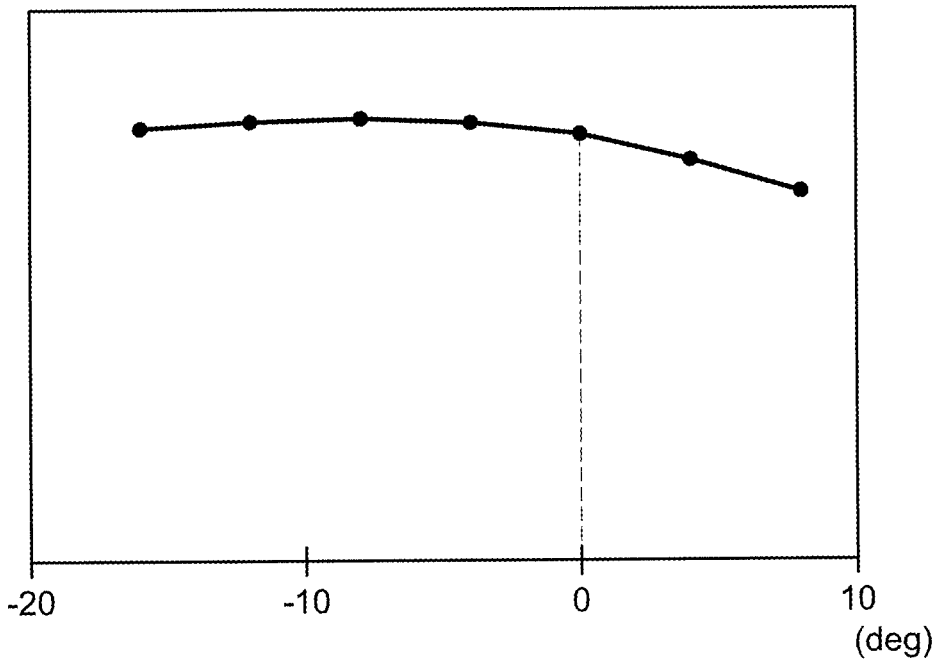
FIG. 9 shows a simulation result showing a relationship between a sweep forward angle $\alpha$ and the flow rate.

FIG. 9 is a graph showing a relationship of the sweep forward angle α and the discharge flow rate, where a horizontal axis indicates the sweep forward angle α and a vertical axis indicates the discharge flow rate (litter/min). The discharge flow rate becomes greater in a case where the sweep forward angle α is smaller than 0 degrees, that is, when a shape thereof is configured such that the line L2 connecting the end of each blade 54*a* on the outer circumferential side of the impeller 54 and the center X is located backward in the rotation, direction R than the line L3 connecting the end of the blade 54*a* on the center X side and the center X than in a case where the sweep forward angle α is equal to or greater than 0 degrees, that is, when the shape thereof is configured such that the line L2 is located frontward in the rotation direction R than the line L3. That is, the pump efficiency can be improved by configuring the lines L2 to be located backward in the rotation direction R than the lines L3.

Figure 10:
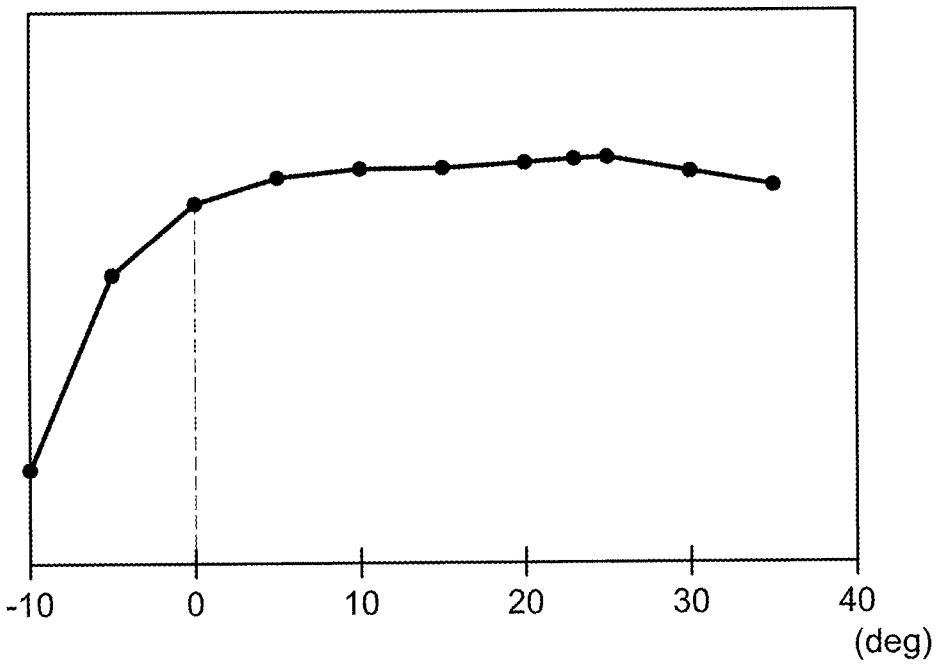
FIG. 10 shows a simulation result showing a relationship between an inclined angle $\gamma$ and the flow rate.

In a simulation, the flow rates for the case of varying the inclined angle γ (see FIG. 6) were calculated. Note that in this simulation, the sweep forward angle α and the setting angle β were not changed and were set respectively as constant angles. FIG. 10 is a graph showing a relationship of the inclined angle γ and the discharge flow rate, where a horizontal axis indicates the inclined angle γ and a vertical axis indicates the discharge flow rate (litter/min). The inclined angle γ of the impeller 54 of the present embodiment is greater than 0 degrees. The discharge flow rate becomes greater in a case where the inclined angle γ is greater than 0 degrees, that is, when each of the blades 54*a* located between the blade grooves 54*b* opened at the upper surface 54*g* has a shape in which the end thereof on the upper surface 54*g* side is located frontward in the rotation direction R than the end thereof on the lower surface 54*h* side than in a case where the inclined angle γ is equal to or smaller than 0 degrees, that is, in a shape in which the end thereof on the upper surface 54*g* side is located backward in the rotation direction R than the end thereof on the lower surface 54*h* side. That is, in each of the blades 54*a* located between the blade grooves 54*b* opened at the upper surface 54*g*, the pump efficiency can be improved by arranging the end thereof on the upper surface 54*g* side to be located frontward in the rotation direction R than the end thereof on the lower surface 54*h* side.

Further, in the impeller 54, the blade grooves 54*b* opened at the upper surface 54*g* are not opened at the lower surface 54*h* and are closed thereat. The blade grooves 54*b* opened at the lower surface 54*h* are not opened at the upper surface 54*g* and are closed thereat. According to this configuration, due to the blade grooves 54*b*, the gas can be guided in the swirling direction in the space defined by the blade grooves 54*b* and the opposing groove 52*e* or by the space defined by the blade grooves 54*b* and the opposing groove 52*f*. Due to this, the gas can smoothly be swirled to pressurize it.

According to the configuration of the purge pump 10 of the present embodiment, the gas in the space defined by the blade grooves 54*b* and the opposing groove 52*e* or by the blade grooves 54*b* and the opposing groove 52*f* can smoothly be swirled, and occurrences of separated flows can be suppressed. Further, the gas suctioned from the canister 73 has a relatively small density. By using the purge pump 10, even such a gas with the relatively small density can be pressurized without setting the revolution speed of the impeller 54 high. Due to this, the purge pump 10 can be configured less power consuming. Further, by suppressing the revolution speed, wear in a bearing of the shaft 30 can be suppressed.

Specific examples of the present disclosure have been described in detail, however, these are mere exemplary indications and thus do not limit the scope of the claims. The art described in the claims include modifications and variations of the specific examples presented above.

For example, the shape of the outer circumferential wall 54*c* of the impeller 54 is not limited to the shape in the embodiment. For example, the outer circumferential wall 54*c* may be arranged at a central portion in an up and down direction of the impeller 54 while not being arranged at upper and lower end portions of the impeller 54. In this case, an upper end of the outer circumferential wall 54*c* may be located at a same position as the vortex center or thereabove in the up and down direction. Similarly, for a lower end of the outer circumferential wall 54*c*, it may be located at the same position as the vortex center or therebelow in the up and down direction.

Further, in the above embodiment, the blades 54*a* and the blade grooves 54*b* of the impeller 54 have same shapes on the upper and lower surfaces 54*g*, 54*h*. However, the shapes of the blades 54*a* and the blade grooves 54*b* may be different in the upper surface 54*g* from those of the lower surface 54*h*. Alternatively, the blades 54*a* and the blade grooves 54*b* may be arranged on only one of the upper and lower surfaces 54*g*, 54*h*. Further, the shapes of the plurality of blades 54*a* may differ from each other in each of the upper and lower surfaces 54*g*, 54*h*, and the plurality of blades 54*a* do not have to be arranged at regular intervals. Similarly, the shapes of the plurality of blade grooves 54*b* may differ from each other, and the plurality of blade grooves 54*b* do not have to be arranged at regular intervals.

Further, in the above embodiment, the suction port 56 and the discharge port 58 of the pump unit 50 extend in the direction perpendicular to the rotation axis X of the impeller 54. However, the suction port 56 and the discharge port 58 of the pump unit 50 may be extending in parallel to the rotation axis X.

The "vortex pump" disclosed herein is not limited to the purge pump 10, and may be used in other systems. For example, it may be used as a pump that supplies an exhaust to the suction pipe 80 in an exhaust recirculation (that is, EGR (abbreviation of Exhaust Gas Recirculation)) for circulating the exhaust of the engine 8, mixing it with suctioned air, and supplying the same to a fuel chamber of the engine 8. Further, it may be used as an industrial pump other than for the vehicle.

Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

The invention claimed is:

1. A vortex pump configured to pump gas, the pump comprising:

a housing; and an impeller housed in the housing and configured to rotate about a rotation axis, wherein the impeller comprises:

a plurality of blades disposed along a rotation direction in an outer circumferential portion of each of two end surfaces of the impeller;

a plurality of blade grooves, each of the plurality of blade grooves being disposed between adjacent blades; and an outer circumferential wall disposed at an outer circumferential edge and closing the plurality of grooves at an outer circumferential side of the impeller, wherein the housing comprises an opposing groove opposing a blade groove region and extending along the rotation direction of the impeller, each of the plurality of the blade grooves is opened at the one end surface of the impeller, and closed at the other end surface of the impeller, and in a plan view of the one end surface of the impeller, each of the plurality of the blades is curved, and a central portion of each of the blades is positioned frontward in the rotation direction of the impeller than both end portions of the blade, each of the plurality of the blades on the one end surface of the impeller is inclined such that the end portion thereof on the one end surface side of the impeller is positioned frontward in the rotation direction of the impeller than the end portion thereof on the other end surface side of the impeller, and each of the plurality of the blades on the one end surface of the impeller comprises constantly sloped inclined surfaces on both sides in the rotation direction of the impeller, a distance between the constantly sloped inclined surfaces of each of the plurality of the blades on the one end surface of the impeller gradually spreads from the one end surface toward the other end surface of the impeller, and a thickness of each of the plurality of the blades on the one end surface of the impeller gradually increases from the one end surface to the other end surface side of the impeller.

2. The vortex pump as in claim 1, wherein in the plan view of the one end surface of the impeller, in each of the plurality of the blades, a line connecting an end thereof on an outer circumferential side of the impeller and a center of the impeller is positioned backward in the rotation direction of the impeller than a line connecting an end thereof on a central side of the impeller and the center of the impeller.

3. The vortex pump as in claim 1, wherein the vortex pump is configured to:

be mounted on an automobile;

suction vaporized fuel from a canister adsorbing the vaporized fuel in a fuel tank into the vortex pump; and supply the suctioned vaporized fuel to an intake pipe of an engine of the automobile.

* * * * *